US006655578B2

(12) United States Patent
Ward

(10) Patent No.: US 6,655,578 B2
(45) Date of Patent: Dec. 2, 2003

(54) INSTRUMENT FOR COMPUTING PROPORTIONS OF AN ORIGINAL RECIPE

(76) Inventor: Eileen Ward, 200 Somerset St., Trenton, NJ (US) 08638

( * ) Notice: Subject to any disclaimer, the term of this patent is extended or adjusted under 35 U.S.C. 154(b) by 65 days.

(21) Appl. No.: 09/969,918

(22) Filed: Oct. 3, 2001

(65) Prior Publication Data

US 2003/0066873 A1 Apr. 10, 2003

(51) Int. Cl.[7] ..... G06G 27/00
(52) U.S. Cl. ..... 235/74; 235/61 R
(58) Field of Search ..... 235/61 R, 65, 235/66, 74

(56) References Cited

U.S. PATENT DOCUMENTS

| | | | | |
|---|---|---|---|---|
| 2,098,394 A | | 11/1937 | Lane | |
| 2,111,268 A | | 3/1938 | Kohlenberger | |
| 2,150,442 A | | 3/1939 | Herzog | |
| 2,190,814 A | | 4/1940 | Walmsley | |
| 2,420,762 A | | 5/1947 | Torrence | |
| 2,965,358 A | | 10/1960 | Pennington | |
| 3,716,237 A | * | 2/1973 | Locher | 235/74 |
| 3,746,250 A | * | 7/1973 | Goodhouse et al. | 235/61 R |
| 3,905,547 A | * | 9/1975 | Cyre et al. | 235/90 |
| 3,977,106 A | | 8/1976 | Knapp | 40/70 R |
| 4,048,477 A | | 9/1977 | Hungerford | 235/88 R |
| 4,599,508 A | * | 7/1986 | Smetaniuk | 235/116 |

OTHER PUBLICATIONS

Article Philadelphia Inquirer Oct. 4, 2000.

* cited by examiner

*Primary Examiner*—Daniel St. Cyr
(74) *Attorney, Agent, or Firm*—William L. Muckelroy; Art Lessler; Gary Lipson

(57) ABSTRACT

A hand-held instrument for calculating the measurements necessary to prepare any number of servings or serving sizes from a printed food recipe which utilizes two concentric rotating wheels, the lower one of the wheels having instructions printed thereon in a 120 degree segment and measurement data thereon for use in conjunction with said upper wheel, the upper wheel having twelve segments with alternate segments being blank and transparent and the remaining segments having measurement data displayed thereon for use in conjunction with the lower wheel.

18 Claims, 1 Drawing Sheet

INSTRUMENT FOR COMPUTING PROPORTIONS OF AN ORIGINAL RECIPE

FILING DATE AND NOTICE OF CO-PENDING APPLICATIONS

The applicant claims as a filing date, the date on which this application was received by the United States Patent Office. There are no co-pending related applications filed by the applicant as of the date of filing of this application.

BACKGROUND

1. Field of Invention

This invention pertains to an instrument for computing proportions or fractions of an originally printed, published or displayed recipe to a fraction of the fixed number of servings indicated by the recipe.

2. Background

In 1936 Lane et al. received U.S. Pat. No. 2,098,394 for a recipe file which was an improved combination of a container, data and index cards useful in the assembly and examination of cooking recipes. Pivotally mounted on an index card by an eyelet was an information disc divided into a series of equal spaces around the periphery to coincide with an opening cut in the top edge of the index card. In 1937, Kohlenberger in U.S. Pat. No. 2,111,268 invented a further improvement in the art of cooking by providing a novel means by which the exact time for cooking various vegetables and the like may be ascertained by a rotatably moving disc with an indicator pointing the vegetable desired. In 1940 Walmsley was issued U.S. Pat. No. 2,190,814 for a reference cabinet which accurately specified the kind and amounts of ingredients for a desired "size" as a measure or weight of a batch or mixture, covering a complete variety of baking formulas and adapted specifically for use in a shop routine. In 1939 Herzog received U.S. Pat. No. 2,150,442 for a calorie counting pivoting wheel or calculator permitting the ready addition of the number of calories contained in combinations of foods in any variety.

In 1947 Torrence received U.S. Pat. No. 2,420,762 for wheeled pivoting device with discs arranged one above the other to indicate the value of vitamins and minerals in certain types of foods. Then, in 1960 Pennington received U.S. Pat. No. 2,956,358 for pivoting wheeled disc device for menu selection wherein weight is given to the chemistry of the foods selected and wherein the use of seasonal foods at the wrong time of year is avoided using the device. A similar nutrition indicating device was described in U.S. Pat. No. 3,977,106 in 1976 where a flat circular chart with a flat wheel rotatably pivoted at each side of the chart wherein foods are colored coded on the chart and the relative quantities of food items to provides specific calories or nutrients is shown. A related device of similar construction was patented in 1977 in U.S. Pat. No. 4,048,477 which issued to Hungerford. The device is a hand held weight control calculator which allows an individual to quickly and accurately determined the daily maximum food calories allowed for maintaining, gaining, or losing weight.

BRIEF DESCRIPTION OF THE DRAWING

Various objects, features and alternate advantages of the invention will be more fully appreciated as the same becomes better understood with reference to the following detailed description of the present invention when considered in connection with the accompanying drawings, in which.

DETAILED DESCRIPTION

Figure 1:
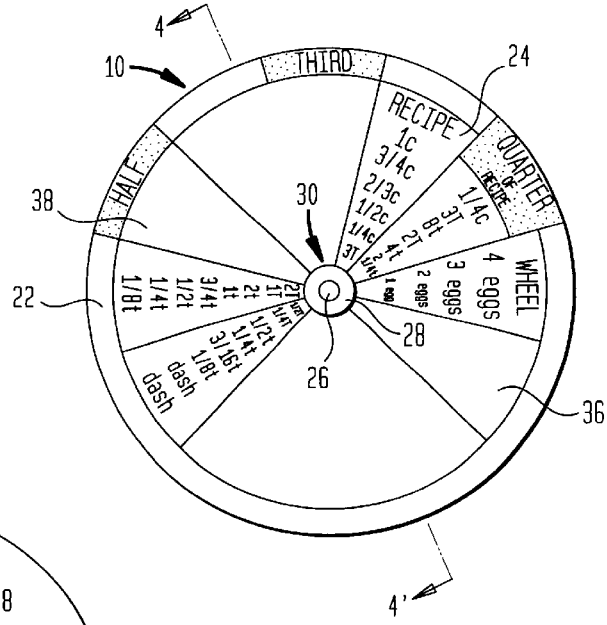
FIG. 1 is a representation of the preferred embodiment of an instrument for computing proportions of a recipe or recipe sizing wheel, assembled from three concentrically rotating disks, as it appears in actual operation.

There is shown in FIG. 1 a representation of the preferred embodiment of an instrument for computing proportions of a recipe, namely, a recipe sizing wheel 10, assembled from two concentrically rotating lower and upper disks 22 and 24, as it appears in actual operation. The lower disk 22 is located below or underneath the disk 24. Hence, the upper disk 24 is located above or on top of the disk 22. Each the disks 22 and 24 have central first and second apertures 26 and 28, respectively, adapted to receive a rivet 30.

In FIG. 1 the lower disk 22 and the upper 24 are shown rotably connected to each other via the rivet 30 inserted through concentric apertures 26 and 28.

Figure 2:
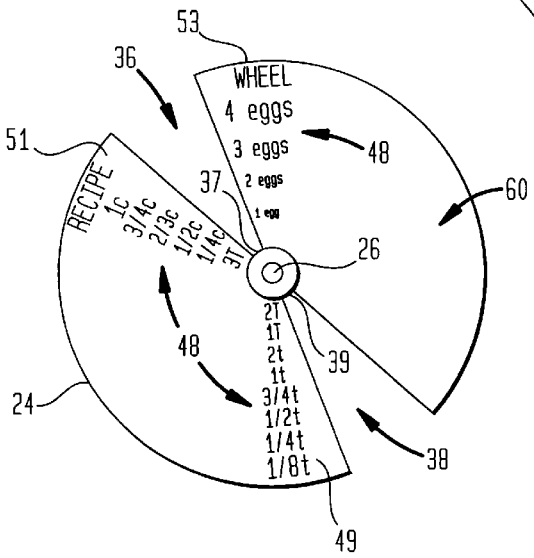
FIG. 2 is a representation of an embodiment of the lowermost or inner disk of the recipe sizing wheel.
Figure 3:
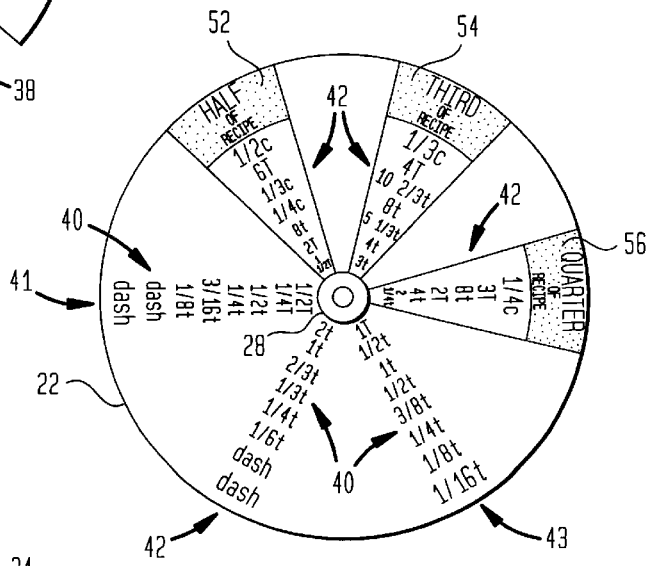
FIG. 3 is a representation of an embodiment of the uppermost or outer disk of the recipe sizing wheel.

The recipe sizing wheel 10 is made up of the lower disk 22 as shown in FIG. 3 and the upper disk 24 as shown in FIG. 2. The disks 22 and 24 are connected together in their centers by the rivet 30 as illustrated more fully in FIG. 3. The recipe sizing wheel 10 operates by rotating the upper disk 24 in a prescribed manner with respect to the lower disk 22 to calculate less than full portions or multiples of portions for which a recipe is written or expressed. The recipe sizing wheel 10 allows any cook or chef that uses recipes, whether from a cookbook, magazine, or newspaper, etc. to quickly, effortlessly and accurately reduce or increase the number of servings a recipe prepares.

Figure 4:
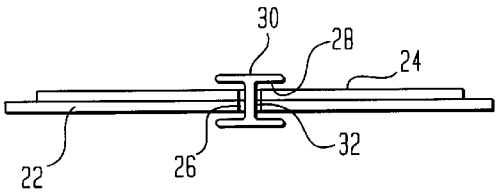
FIG. 4 is cross-section of the preferred embodiment of the instrument for computing proportions of a recipe shown in FIG. 1 taken along the line 4–4'.

As illustrated in FIG. 4, the rivet 30 has an elongated shank 32 about which the disk 22 and the disk 24 each freely rotate. The upper disk 24 is approximately 0.125 cm. smaller in diameter, for example, than the lower disk 22. This difference in diameters allows the user to see the designations indicated along the outer 0.125 cm. margin of the lower disk 22. The upper disk 24 has first and second pie-slice shaped windows 36 and 38 as shown in FIGS. 1 and 2. The first and second pie-slice shaped windows 36 and 38 have first and second pointed ends 37 and 39, respectively. The first and second pointed ends 37 and 39 are selectively arranged such that each is near or adjacent the rivet 30.

The upper disk 24 has at least three functionalities, namely, (a) the first pie-slice shaped window 36 and the second pie-slice shaped window 38 each allow access by the user to first and second printed material groups 40 and 44 exhibited on the lower disk 22; (b) the upper disk 24 exhibits a third printed material group 48 in an easy-to-read, easy-to-understand format; and, (c) the upper disk 24 has a relatively large printable area 60 on which may be displayed copyrighted or uncopyrighted directions which succinctly direct how to use the instrument, i.e. the recipe sizing wheel 10. These directions may captioned as follows and comprise or, be selected from the following, to wit:

| DIRECTIONS TO REDUCE THE SERVING SIZE OF ANY RECIPE |
|---|
| 1. Locate reduction amount on bottom wheel. |
| 2. Position top wheel over shaded or colored area (the color would be specified). |
| 3. Locate measurement or number of whole eggs on top wheel. |
| 4. Use measurement on bottom wheel. |
| 5. For measurements over 1 cup or 4 eggs, repeat steps 3 and 4. |
| 6. Repeat steps 3 thru 5 for each ingredient. |
| 7. For whole egg to egg substitute conversion, use slightly less. |

As further shown in FIG. 1, the lower disk 22 exhibits to a user amounts and measurements for the ingredients in the recipe under construction and which are to be reduced. For example, the first printed matter group 40 comprises three columns 41, 42, and 43 of measurements.

Proceeding from the rivet 28 outward the column 41 shows, for example:

½T
¼T
½t
¼t
3/16t
⅛t
dash
dash

Likewise, the column 42, for example, shows or displays starting from the rivet 28 and at the same corresponding respective specified progressive radial distances, the following:

2t
1t
⅔t
⅓t
¼t
⅙t
dash
dash

Likewise, the column 43, for example, shows or displays starting from the rivet 28 and at the same corresponding respective specified progressive radial distances, the following:

1T
½T
1t
½t
⅜t
¼t
⅛t
1/16t

Referring to FIG. 2, there is shown the upper disk 24. The upper disk 24 exhibits to a user amounts and measurements for the ingredients in the recipe under construction in the third printed material group 48. There are shown three columns 49, 51, and 53. For example, the printed matter is depicted in column 49 for use in calculating measurements. Proceeding from the rivet 28 outward at the same aforementioned corresponding respective specified progressive radial distances, the column 49 shows, for example:

2T
1T
2t
1t
¾t
½t
¼t
⅛t

The column 51, at its outermost radial location is entitled "RECIPE", for example, and shows or displays starting from the rivet 28 and at the same corresponding aforementioned respective specified progressive radial distances, the following:

3T
¼c
⅓c
½c
⅔c
¾c
1c
RECIPE

Likewise, the column 53, for example, shows or displays starting from the rivet 28 and at the same corresponding aforementioned respective specified progressive radial distances, the following, for example:

- - -=1
1 egg
- - -=1
2 eggs
- - -=1
3 eggs
4 eggs
WHEEL

In a recipe, an item such as an orange, an apple, avocado, etc. may selectively be substituted for egg or eggs in the above column.

Referring to FIG. 3, there is shown the lower disk 22. The lower disk 22 further exhibits to a user amounts and measurements for fractional amounts of the ingredients in the recipe under construction in the second printed material group 44. There are shown three columns 52, 54, and 56. For example, the printed matter depicted in column 52 is entitled "HALF" at an outermost radial distance space. The column 52 is for use in calculating measurements for one-half of the recipe. Proceeding from the rivet 28 outward at the same aforementioned corresponding respective specified progressive radial distances, the column 52 shows, for example:

1½T
2T
8t
¼c
⅓c
6T
½c
the recipe

The column 54, at its outermost radial location is entitled "THIRD", for example, and shows or displays starting from the rivet 28 and at the same corresponding aforementioned respective specified progressive radial distances, the following:

3t
4t
5⅓t
8t

10⅔t
4T
⅓c
the recipe

Likewise, the column 56, at its outermost radial location is entitled "QUARTER", for example, and shows or displays starting from the rivet 28 and at the same corresponding aforementioned respective specified progressive radial distances, the following:

2¼t
1T
4t
2T
8t
3T
¼c
the recipe

In all cases, it is understood that the above-identified arrangements are merely illustrative of the many possible specific embodiments which represent applications of the present invention. Numerous and varied other arrangements can readily be devised in accordance with the principles of the present invention without departing from the spirit and scope of the invention.

Parts List recipe sizing wheel 10
lower disk 22
upper disk 24
first aperture 26
second aperture 28
rivet 30
elongated shank 32
first pie-slice shaped window 36
first pointed end 37
second pie-slice shaped window 38
second pointed end 39
first printed material group 40
column 41
column 42
column 43
second printed material group 44
column 52
column 54
column 56
third printed material group 48
column 49
column 51
column 53
large printable area 60

What is claimed is:

1. An instrument for computing proportions of an original recipe for a fixed number of servings other than specified in said recipe comprising:

(a) A substantially round inner upper wheel;

(b) A substantially round outer lower wheel;

(c) A means for rotatably connecting said inner upper wheel to said outer lower wheel, said means being located substantially at a center of each wheel;

the inner upper wheel being divided into a plurality of sectors, the inner upper wheel having first and second 60" sectors, said first and second 60" sectors being diametrically opposite each other, one 120" sector located to the right and in between said first and second 60" sectors, and, one 90" sector located to the left and in between said first and second 60" sectors;

the first 60" sector being equally divided into a first right 30" sector and a second left 30" sector, the first right 30" sector comprising a first open space located left of said first right 30" sector, said second left 30" sector being the first open space, the first right 30" sector displaying at least eight substantially equally wide concentric radial sectors of an annulus, each of the substantially equally wide concentric radial sectors of an annulus having circularly concentric parallel trapezoid sides and each of the substantially equally wide concentric radial sectors of an annulus having a linear right radial side extending in between a top side and a bottom side of an annulus; and, each of the substantially equally wide concentric radial sectors of an annulus having a lineal left radial side extending in between the top side and the bottom side of an annulus; and, beginning from the center of the inner upper wheel, each of a first substantially equally wide concentric radial sector of a first annulus, a third substantially equally wide concentric radial sector of a third annulus, and a fifth substantially equally wide concentric radial sector of a fifth annulus being blank, and each of a second substantially equally wide concentric radial sector of a second annulus, a fourth substantially equally wide concentric radial sector of a fourth annulus, and a sixth substantially equally wide concentric radial sector of a sixth annulus displaying a term;

the second substantially equally wide concentric radial sector of the second annulus having displayed thereon a term indicating a quantity pertaining to an egg;

the fourth substantially equally wide concentric radial sector of the fourth annulus having displayed thereon a quantity pertaining to an egg;

the sixth substantially equally wide concentric radial sector of an annulus having displayed thereon a quantity pertaining to an egg;

a seventh substantially equally wide concentric radial sector of a seventh annulus having displayed thereon the term a quantity pertaining to an egg;

an eighth substantially equally wide concentric radial sector of an eighth annulus having displayed thereon the term WHEEL;

the second 60" sector being equally divided into a third counterclockwise 30" sector and a fourth clockwise 30" sector, the third counterclockwise 30" sector comprising an open space left of the fourth clockwise 30" sector, the fourth clockwise 30" sector displaying at least eight substantially equally wide concentric radial sectors of an annulus, each of the substantially equally wide concentric radial sectors of an annulus having circularly concentric parallel trapezoid sides and each of the substantially equally wide concentric radial sectors of an annulus having a linear right radial side extending in between a top side and a bottom side of an annulus; and, each having a lineal left radial side extending in between the top and the bottom side of an annulus; beginning from the center of the inner upper wheel, the first, third, and fifth substantially equally wide concentric radial sectors of an annulus being blank, the first substantially equally wide concentric radial sector of an annulus having displayed thereon the term 2T;

the second substantially equally wide concentric radial sector of an annulus having displayed thereon the term 1T;

the third substantially equally wide concentric radial sector of an annulus having displayed thereon the term 2t;

the fourth substantially equally wide concentric radial sector of an annulus having displayed thereon the term 1t;

the fifth substantially equally wide concentric radial sector of an annulus having displayed thereon the term ¾t;

the sixth substantially equally wide concentric radial sector of an annulus having displayed thereon the term ½t;

the seventh substantially equally wide concentric radial sector of an annulus having displayed thereon the term ¼t; and the eighth substantially equally wide concentric radial sector of an annulus having displayed thereon the term ⅛.

2. The instrument according to claim 1 wherein the second 60" sector is located clockwise 120" from the first 60" sector; the 120" sector occupying a circular space of 120" clockwise rotation from the first 60" sector; and, wherein another 30" sector is located counterclockwise adjacent said first blank space.

3. The instrument according to claim 2 wherein the outer lower wheel is comprised of about twelve segments of a circle wherein alternate segments are blank and remaining segments each have information displayed thereon and wherein said information is displayed in concentric sectors of annuli.

4. The instrument according to claim 3 wherein said segments are substantially equally arrayed radially apart.

5. The instrument according to claim 4 wherein said twelve segments each occupy about 30".

6. The instrument according to claim 5 wherein each of the about 30" segments having information displayed thereon and confined in concentric sectors of an annulus further comprises at least nine equally spaced concentric sectors of annuli and wherein a first segment has indicated thereon proceeding from an outermost annulus to an innermost annulus a following sequence of food measurement information consisting of half, of, recipe, ½c, 6T, ⅓c, ¼c, 8t, 2T, and 1½T.

7. The instrument according to claim 6 wherein a second clockwise segment has indicated thereon, proceeding from an outermost annulus to an innermost annulus the following food measure information in the following sequence: third, of, recipe, ⅓c, 4T, 10⅔t, 8t, 5⅓t, 4t, and 3t.

8. The instrument according to claim 7 wherein a third clockwise segment has indicated thereon, proceeding from an outermost annulus to an innermost annulus the following food measure information in the following sequence: quarter, of, recipe, ¼c, 3T, 8t, 2T, 4t, and 2¼t.

9. The instrument according to claim 8 wherein a fourth clockwise segment has indicated thereon, proceeding from an outermost annulus to an innermost annulus the following food measure information in the following sequence: a first blank space, 1/16t, ⅛t, ¼t, ⅜t, ½t, 1t, and 1T.

10. An instrument for computing proportions of an original recipe for a fixed number of servings other than specified in said recipe comprising:

(a) A substantially round inner upper wheel;

(b) A substantially round outer lower wheel;

(c) A means for rotatably connecting said inner upper wheel to said outer lower wheel, said means being located substantially at a center of each wheel;

the inner upper wheel being divided into a plurality of sectors, the inner upper wheel having first and second 60" sectors, said first and second 60" sectors being diametrically opposite each other, one 120" sector located to the right and in between said first and second 60" sectors, and, one 90" sector located to the left and in between said first and second 60" sectors;

the first 60" sector being equally divided into a first right 30" sector and a second left 30" sector, the first right 30" sector comprising a first open space located left of said first right 30" sector, said second left 30" sector being the first open space, the first right 30" sector displaying at least eight substantially equally wide concentric radial sectors of an annulus, each of the substantially equally wide concentric radial sectors of an annulus having circularly concentric parallel trapezoid sides and each of the substantially equally wide concentric radial sectors of an annulus having a linear right radial side extending in between a top side and a bottom side of an annulus; and, each of the substantially equally wide concentric radial sectors of an annulus having a lineal left radial side extending in between the top side and the bottom side of an annulus; and, beginning from the center of the inner upper wheel, each of a first substantially equally wide concentric radial sector of a first annulus, a third substantially equally wide concentric radial sector of a third annulus, and a fifth substantially equally wide concentric radial sector of a fifth annulus being blank, and each of a second substantially equally wide concentric radial sector of a second annulus, a fourth substantially equally wide concentric radial sector of a fourth annulus, and a sixth substantially equally wide concentric radial sector of a sixth annulus displaying a term;

the second substantially equally wide concentric radial sector of the second annulus having displayed thereon a first egg-related quantity;

the fourth substantially equally wide concentric radial sector of the fourth annulus having displayed thereon a second egg-related quantity;

the sixth substantially equally wide concentric radial sector of an annulus having displayed thereon a third egg-related quantity;

a seventh substantially equally wide concentric radial sector of a seventh annulus having displayed thereon a fourth egg-related quantity;

an eighth substantially equally wide concentric radial sector of an eighth annulus having displayed thereon a non-egg related term;

the second 60" sector being equally divided into a third counterclockwise 30" sector and a fourth clockwise 30" sector, the third counterclockwise 30" sector comprising an open space left of the fourth clockwise 30" sector, the fourth clockwise 30" sector displaying at least eight substantially equally wide concentric radial sectors of an annulus, each of the substantially equally wide concentric radial sectors of an annulus having circularly concentric parallel trapezoid sides and each of the substantially equally wide concentric radial sectors of an annulus having a linear right radial side extending in between a top side and a bottom side of an annulus; and, each having a lineal left radial side extending in between the top and the bottom side of an annulus; beginning from the center of the inner upper wheel, the first, third, and fifth substantially equally wide concentric radial sectors of an annulus being blank, the first substantially equally wide concentric radial sector of an annulus having displayed thereon a first measure;

the second substantially equally wide concentric radial sector of an annulus having displayed thereon a second measure;

the third substantially equally wide concentric radial sector of an annulus having displayed thereon a third measure;

the fourth substantially equally wide concentric radial sector of an annulus having displayed thereon a fourth measure;

the fifth substantially equally wide concentric radial sector of an annulus having displayed thereon a fifth measure;

the sixth substantially equally wide concentric radial sector of an annulus having displayed thereon a sixth measure;

the seventh substantially equally wide concentric radial sector of an annulus having displayed thereon a seventh measure; and the eighth substantially equally wide concentric radial sector of an annulus having displayed thereon an eighth measure.

11. The instrument according to claim 10 wherein the second 60" sector is located clockwise 120" from the first 60" sector; the 120" sector occupying a circular space of 120" clockwise rotation from the first 60" sector; and, wherein another 30" sector is located counterclockwise adjacent said first blank space.

12. The instrument according to claim 11 wherein the outer lower wheel is comprised of about twelve segments of a circle wherein alternate segments are blank and remaining segments each have information displayed thereon and wherein said information is displayed in concentric sectors of annuli.

13. The instrument according to claim 12 wherein said segments are substantially equally arrayed radially apart.

14. The instrument according to claim 13 wherein said twelve segments each occupy about 30".

15. The instrument according to claim 14 wherein each of the 30" segments having information displayed thereon and confined in concentric sectors of an annulus further comprises at least nine equally spaced concentric sectors of annuli and wherein a first segment has indicated thereon proceeding from an outermost annulus to an innermost annulus a following sequence of food measurement information consisting of: half, of, recipe, a ninth measure, a tenth measure, an eleventh measure, a twelfth measure, a thirteenth measure, a fourteenth measure equal to the second measure, and a fifteenth measure.

16. The instrument according to claim 15 wherein a second clockwise segment has indicated thereon, proceeding from an outermost annulus to an innermost annulus the following food measure information in the following sequence: third, of, recipe, a sixteenth measure, a seventeenth measure, an eighteenth measure, a nineteenth measure, a twentieth measure, a twenty-first measure, and a twenty-second measure.

17. The instrument according to claim 16 wherein a third clockwise segment has indicated thereon, proceeding from an outermost annulus to an innermost annulus the following food measure information in the following sequence: quarter, of, recipe, a twenty-third measure, a twenty-fourth measure, a twenty-fifth measure, a twenty-sixth measure, a twenty-seventh measure, a twenty-eighth measure equal to the first measure, and a twenty-ninth measure.

18. The instrument according to claim 17 wherein a fourth clockwise segment has indicated thereon, proceeding from an outermost annulus to an innermost annulus the following food measure information in the following sequence: a blank space, a thirtieth measure, a thirty-first measure, a thirty-second measure, a thirty-third measure equal to the second measure, the twenty-seventh measure, the twenty-eighth measure, and the twenty-ninth measure.

* * * * *